United States Patent [19]

Nelson

[11] Patent Number: 4,538,420

[45] Date of Patent: Sep. 3, 1985

[54] DEFROST CONTROL SYSTEM FOR A REFRIGERATION HEAT PUMP APPARATUS

[75] Inventor: Lorne W. Nelson, Bloomington, Minn.

[73] Assignee: Honeywell Inc., Minneapolis, Minn.

[21] Appl. No.: 566,018

[22] Filed: Dec. 27, 1983

[51] Int. Cl.[3] ..... F25D 21/02

[52] U.S. Cl. ..... 62/140; 62/151; 62/155

[58] Field of Search ..... 62/140, 155, 156, 151, 62/234, 128, 129, 154

[56] References Cited

U.S. PATENT DOCUMENTS

| | | | |
|---|---|---|---|
| 3,062,019 | 11/1962 | Jungemann et al. | 62/140 |
| 3,066,496 | 12/1962 | Jokela | 62/140 |
| 3,077,747 | 2/1963 | Johnson, Jr. | 62/140 |
| 3,107,499 | 10/1963 | Jokela | 62/140 |
| 3,115,018 | 12/1963 | Mobarry | 62/160 |
| 4,104,888 | 8/1978 | Reedy et al. | 62/154 |
| 4,142,374 | 3/1979 | Ansted et al. | 62/155 |
| 4,209,994 | 7/1980 | Mueller et al. | 62/155 |
| 4,251,988 | 2/1981 | Allard et al. | 62/80 |
| 4,251,999 | 2/1981 | Tanaka | 62/155 |
| 4,327,556 | 5/1982 | Zampini et al. | 62/153 |
| 4,327,557 | 5/1982 | Clarke et al. | 62/153 |
| 4,373,349 | 2/1983 | Mueller | 62/155 |
| 4,395,887 | 8/1983 | Sweetman | 62/155 |

FOREIGN PATENT DOCUMENTS

| | | | |
|---|---|---|---|
| 0118549 | 9/1980 | Japan | 62/140 |
| 0095138 | 6/1983 | Japan | 62/155 |

*Primary Examiner*—Harry Tanner
*Attorney, Agent, or Firm*—Clyde C. Blinn

[57] ABSTRACT

A control system for a refrigeration heat pump having an outdoor coil through which air is blown by a fan for extracting heat from outdoor air with means to defrost the coil periodically has a differential pressure responsive means responding to the differential air pressure across the outdoor coil. A time control means periodically operates the heat pump for a time controlled operation for predetermined time period (such as 90 minutes of elapsed operating time) and measures and stores the value of the differential pressure across the coil at the end of the time period in memory. A control means controls the heat pump between the periodically time controlled operations for normal operations for a total elapsed time operation in a pressure controlled operation until the pressure differential as previously stored occurs at which time a defrost cycle is initiated. Periodically a time controlled operation is initiated to update the pressure stored in the memory.

15 Claims, 8 Drawing Figures

DEFROST CONTROL SYSTEM FOR A REFRIGERATION HEAT PUMP APPARATUS

BACKGROUND AND SUMMARY OF THE INVENTION

There are many systems for controlling the defrost operation of the outdoor coil of a refrigeration heat pump apparatus. Experience has traditionally found on heat pumps that a time defrost initiated cycle once every 60 or 90 minutes of elapsed compressor run time is optimum for the worst case when the outdoor temperature is below freezing. The amount of frost during this worst condition is such that the blockage of the outdoor coil is approximately 75%. During times when the outdoor conditions are such that the outdoor coil does not become this blocked, that is, low outdoor humidity, or during cold weather, such frequency of defrost cycling is more often than required. While the air pressure drop through an outdoor coil when the coil is blocked with frost has been used for a defrost control system such as shown in U.S. Pat. No. 3,077,747 issued Feb. 19, 1963, to C. E. Johnson, Jr.; U.S. Pat. No. 3,107,499 issued Oct. 22, 1963, to V. J. Jokela; U.S. Pat. No. 3,062,019 issued Nov. 6, 1962, to L. J. Jungemann, et al; and U.S. Pat. No. 3,066,496 issued Dec. 4, 1962, to V. J. Jokela, often a large pressure drop exists through the outdoor coil when the coil is free of frost. This might be caused by foreign contamination such as dirt, leaves or paper, such things as coil design, that is thin spacing, thin geometry and surface area of the coil and the fan characteristics which affects this pressure drop. The pressure drop also may be quite small as in the case of a high Energy Efficiency Ratio (EER) heat pump where the outdoor coil might be relatively large. Further, the pressure drop can be varied from unit to unit by the outdoor cabinet design which includes leakage of air that may bypass the coil.

All of these systems have a common deficiency in that the systems need to be tailored to a particular heat pump design and to the particular weather conditions. The present invention is concerned with a system to overcome the need of special factory calibration or field adjustment on a demand defrost control.

Specifically, the present invention is concerned with a defrost control system for a refrigeration heat pump wherein the differential pressure is measured across the outdoor coil during a plurality of time controlled operations such as 90 minutes of elapsed compressor operation time, and the highest differential pressure attained during a time controlled operation is used to control the length of normal total compressor operations in a pressure controlled operation before a defrost cycle is accomplished. The heat pump is operated for an extended time period which is selected to be long enough that frosting would occur under any adverse conditions and the differential pressure at the end of that timed operation is measured and stored in a memory. For subsequent operations in between the periodic time controlled operations, the normal operation of the heat pump is accomplished from the space thermostat in pressure controlled operation until the differential pressure across the outdoor coil due to frost reaches a value of that stored in the memory. At that time a defrost cycle is commenced. The differential pressure used for terminating the normal cyclic operation to start the defrost cycle is updated by periodic time controlled operations.

DESCRIPTION OF THE INVENTION

Figure 1:
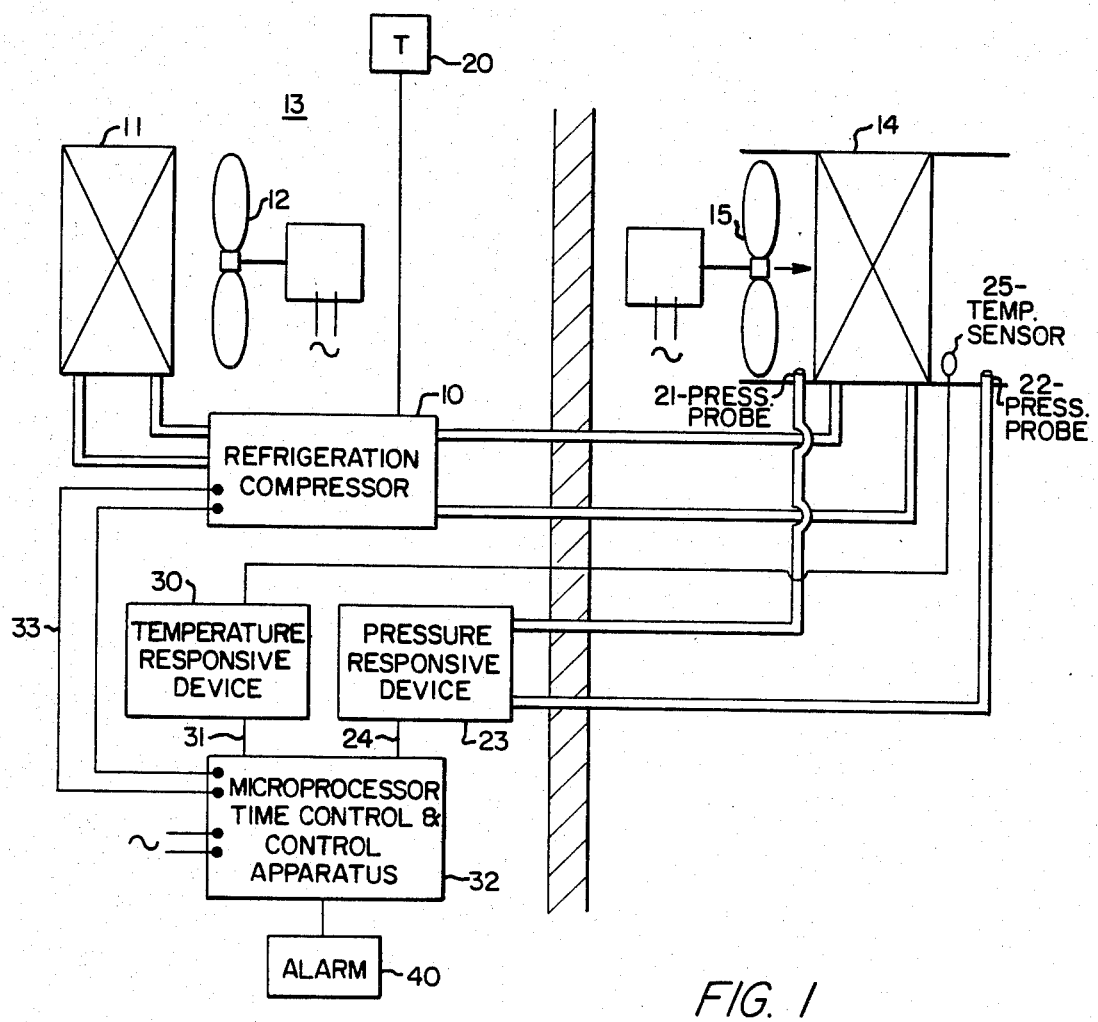
FIG. 1 is a schematic drawing of a refrigeration heat pump system having an outdoor coil differential pressure sensing apparatus.

Referring to FIG. 1, a conventional refrigeration heat pump apparatus is shown having a refrigeration compressor 10 and an indoor coil 11 through which air is blown by a fan 12 for heating and cooling a space 13. An outdoor coil 14 has a fan 15 for blowing outdoor air through the coil to either lose or gain heat. A space or room thermostat 20 is connected to control the refrigeration compressor. Such a refrigeration heat pump system is shown in U.S. Pat. No. 3,115,018 to J. S. Mobarry, issued Dec. 24, 1963.

A pair of pressure probes 21 and 22 on the inlet and outlet side of the outdoor coil 14 are connected to a pressure responsive device 23 providing an output signal at 24 indicative of the differential pressure or air flow restriction through coil 14. One probe may be used with an ambient pressure responsive means at some location as done in the mentioned Jokela U.S. Pat. No. 3,066,496. While differential air pressure is used, any condition which changes indicative of the restriction of air flow or the formation of frost may be used to determine the need for a defrost operation, for example, fan motor current, compressor motor current, differential temperature between coil temperature and outdoor air temperature, weight change of coil when ice accumulates, or any condition which changes as frost accumulates on coil 14. A temperature responsive means or sensor 25 is connected to a temperature responsive device or defrost termination control device 30 having an output indicative of the outdoor coil temperature at 31 as is also shown in the Jokela U.S. patent. A microprocessor control apparatus 32 of a conventional type which would be obvious to anyone skilled in the art is connected to control the refrigeration compressor through circuit 33 for a defrost operation. The method of defrosting the outdoor coil can be any conventional method such as reversing the operation of the system to apply heat to outdoor coil 14.

The refrigeration apparatus having outdoor coil 14 is run for obtaining heat to space 13 for a predetermined total time period which either is continuous operation or cyclic operation to have a cumulative operating time.

Figure 2:
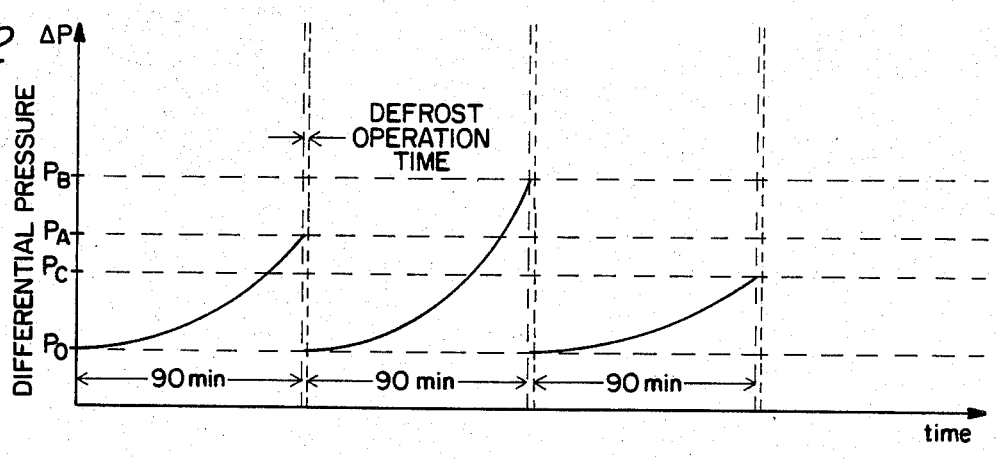
FIG. 2 is a time controlled operation to establish the highest differential pressure.

If the conditions are right for defrost, that is, the outdoor temperature is low enough and the humidity is high enough, a frosting of the outdoor coil will occur to block the air flow through the coil and a signal indicative of the differential pressure is provided between probes 21 and 22. Referring to FIG. 2, three time controlled operations or cycles of 90 minute total cumulative compressor run time are initially made when the system is placed in operation. At the end of each 90 minute operation, a defrost cycle is started which could take 5 or 10 minutes to melt the frost or ice from coil 14. The defrost cycle would be terminated by control apparatus 32 when sensor 25 reached a certain temperature indicative of all frost or ice being melted. The highest differential pressure or pressure value indicative of an air flow restricted coil is measured for the three operations $P_A$, $P_B$ and $P_C$ and the highest differential pressure $P_B$ is retained or stored in the microprocessor memory.

Figure 3:
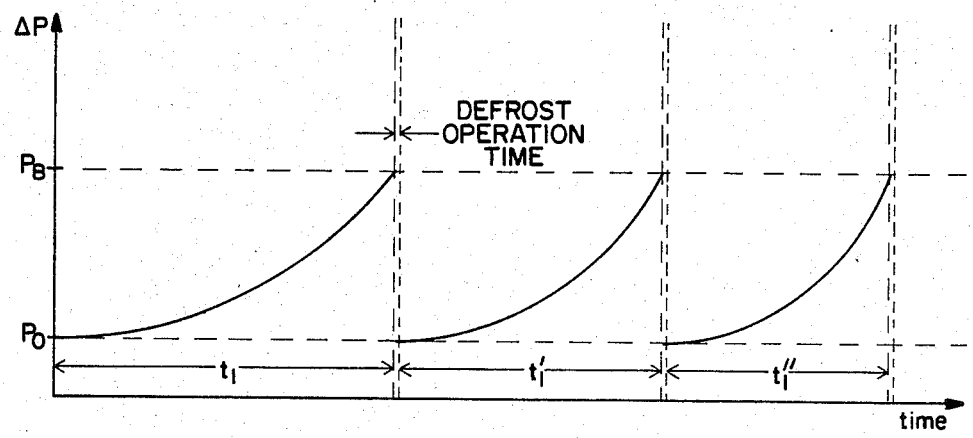
FIG. 3 is a normal pressure controlled operation using the established differential pressure from the operation shown in FIG. 1.

For subsequent automatic cycles or pressure controlled operations of the refrigeration compressor, the operation time period before defrosting takes place is as shown in FIG. 3 as $t_1$, $t_{1'}$ and $t_{1''}$. The compressor is run for a total operation whether it be a series of individual operations for a total cumulative compressor run time or one continuous operation until the differential pressure reaches the previously stored differential pressure $P_B$.

The times $t_1$, $t_{1'}$ and $t_{1''}$ may not be all equal as the compressor would operate a cumulative time until $P_B$ were reached. Obviously, if the ambient temperature and humidity conditions are such that frost doesn't develop, the total compressor run time could be inadequate.

Figure 4:
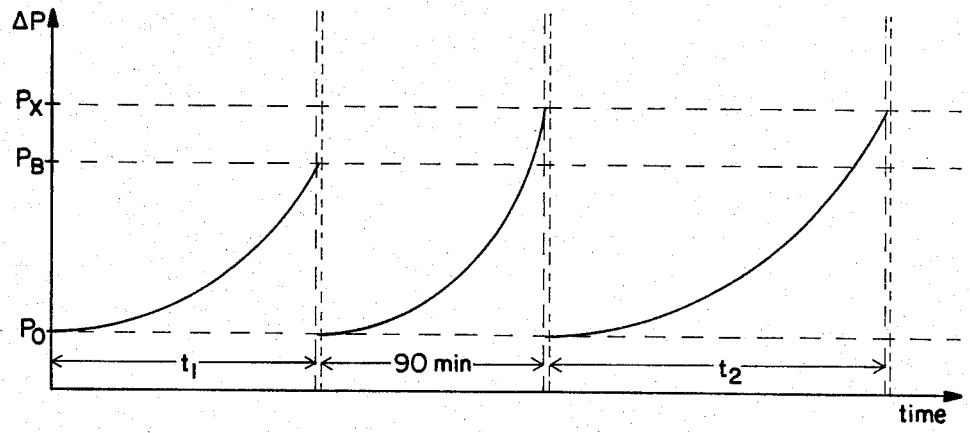
FIG. 4 is an updating of the pressure by interposing a time controlled operation cycle between the normal automatic control.

At definite intervals, the automatic pressure controlled cycle, using $P_B$ for termination, is interrupted by a time controlled operation cycle of 90 minutes to update the memory with a new differential pressure signal for defrost operation. In FIG. 4, the automatic cycle is interrupted by a 90 minute time controlled operation update and a new differential pressure signal $P_X$ is obtained for subsequent automatic cycles and a new time period $t_2$.

Figure 5:
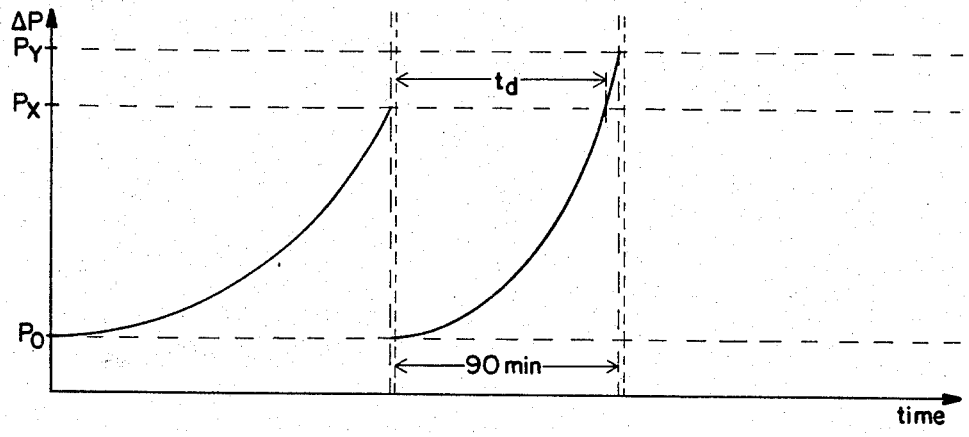
FIG. 5 is a showing of the establishment of a new differential pressure during a normal operation.

Under certain high humidity conditions, it is possible that the normal time cycle to reach a defrost pressure $P_X$ as shown in FIG. 5 is time $t_d$ or less than 90 minutes. This could be used to initiate a time controlled operation of 90 minutes to establish a new pressure signal $P_Y$.

Figure 6:
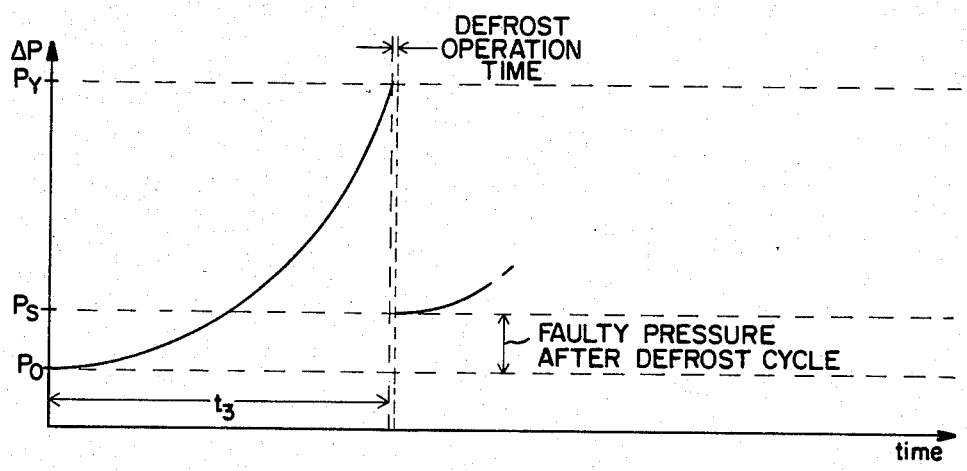
FIG. 6 is a recognition of a faulty operation upon a sudden change in the differential pressure after the completion of a defrost operation.

Upon a drastic change in the pressure measured after a 90 minute time and the defrost cycle was started, a detection of an abnormal deviation or faulty condition can exist. As shown in FIG. 6, the normal automatic control is making use of a differential pressure of $P_Y$; however, after a cleared or defrosted coil, the pressure differential pressure signal $P_S$ is obtained rather than $P_O$. Such would trigger an alarm device 40 as a normally cleared coil should indicate a pressure of $P_O$.

Figure 7:
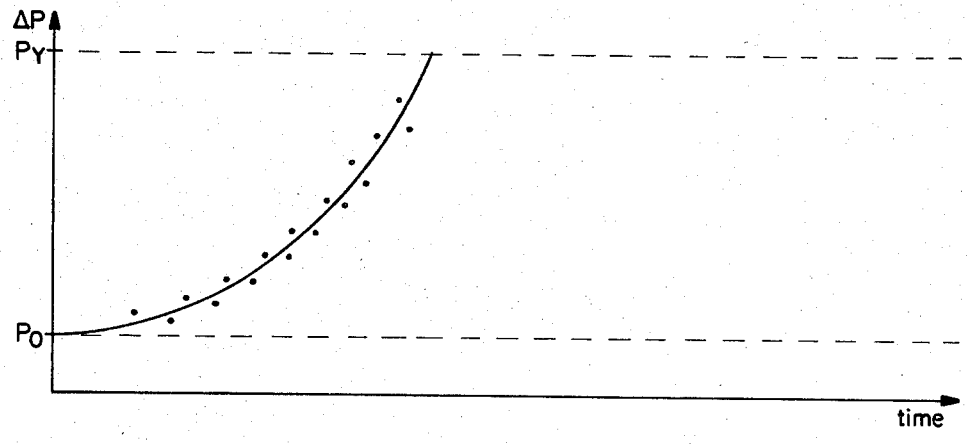
FIG. 7 is a data sampling curve for normal operation.

The data for the various operations of the 90 minute time cycle could be stored in the memory for each time cycle and a curve of pressure drop established with conventional computer averaging technique as shown in FIG. 7. Any time a pressure was measured to be outside the normal range (such as due to a gust of wind) it would be rejected to not influence the system operation.

Figure 8:
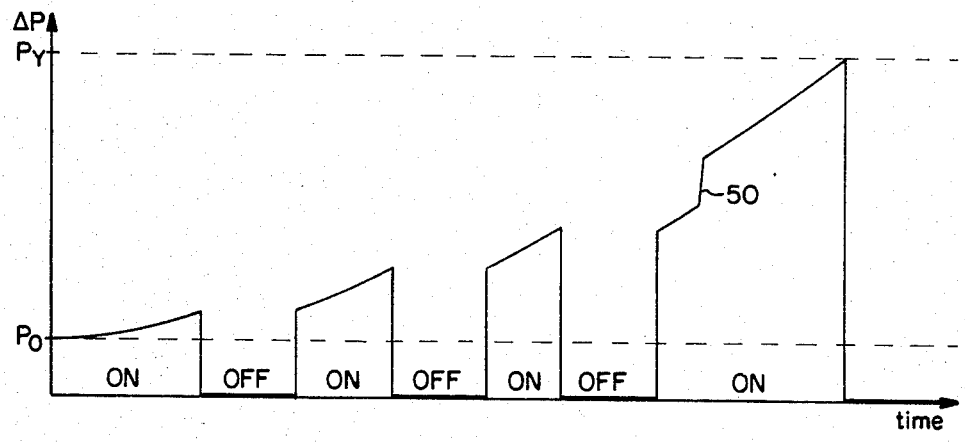
FIG. 8 is a data sampling of periodic operations (of a cumulative time operation) showing the indication of a fault.

While it is understood that the normal operation of a heat pump consists of several operations making up the cumulative compressor operating time, the buildup of ice or frost on the outdoor coil is gradual. An additional buildup takes place each on cycle. The pressure drop across the coil thus increases with each individual operating "on" cycle as shown in FIG. 8. After a complete build up of frost on the coil exists to reach the differential pressure $P_Y$ which previously was established by a timed operation initiates a defrost operation. As shown in FIG. 8, a drastic change in the pressure curve took place in the last "on" cycle at 50 which could have been the result of a foreign blockage of the outdoor coil. The microprocessor would sense this drastic change when comparing such pressure build-up with the stored data of FIG. 7. Appropriate action such as alarm 40 could be taken.

While temperature responsive device or sensor 25 is used to terminate the defrost operation through control apparatus 32, the time required for defrosting coil 14 would be measured by a timing unit in control apparatus 32. An excessive defrost time may indicate too much frost was allowed to build up on the coil to lose operation efficiency. Should the time to completely defrost coil 14 be excessive (being determined by the time needed to raise the temperature of sensor 25 to a predetermined temperature) the pressure controlled operation could be shortened by a reduction in the terminating differential pressure (such as from $P_X$ back to $P_B$ in FIG. 4). Lower pressure controlled operation cycles could be selected to eliminate an inefficient operation.

OPERATION OF THE INVENTION

Assuming that the present control system were installed on a refrigeration heat pump as shown in FIG. 1, upon initial operation of the heat pump, the control system must establish the optimum operation time which can take place before a defrost cycle is commenced. The arbitrary time operation has been selected as 90 minutes but could vary depending upon the design of the heat pump and the geographical area in which the heat pump was to be used. Initially the control apparatus 32 allows the heat pump to operate for 90 minutes either continuously or for 90 minutes of total cumulative time. Assuming the conditions of humidity and outdoor temperature are such to cause frost to form on the coil, at the end of the 90 minute period of time controlled operation, as shown in FIG. 2, a differential pressure would be reached depending upon the restriction of air flow through the coil 14 and is shown as $P_A$. This differential pressure $P_A$ is stored in the memory of the microprocessor and the control apparatus 32 would then initiate a defrost cycle by a conventional defrosting operation to remove the existing frost from coil 14. After the defrost operation which might require several minutes of time (shown in FIG. 2 as defrost operation time between the 90 minute cycles), another time controlled operation of 90 minutes is started. After three such operations for the 90 minute time controlled operation, the highest of the three differential pressures $P_B$ is selected and stored in the memory.

Obviously, if the compressor were started during a period when the outdoor temperature was high or the humidity was very low, it is very possible that no frost would occur on the coil 14 after the 90 minutes of operation, and the differential pressure would be very low. As will be mentioned, the time controlled operation is periodically repeated; therefore, if no frost existed on the first time controlled operation, a later time controlled operation may provide a differential pressure signal due to frost occurring. Obviously, if the preliminary timed periods occur while the outdoor temperature is such that no frost forms on the outdoor coil there would be no increase in the differential pressure during the timing period. In this case the differential pressure would be arbitrarily set at some low value for preliminary defrost initiation.

Subsequent operations of the heat pump will not be time controlled but will be a pressure controlled operation determined by the length of time needed for the pressure differential across the coil 14 to reach the value of $P_B$ previously selected as the highest differential pressure for the time controlled sampling. As shown in FIG. 3, subsequent operations would have times $t_1$, $t_{1'}$ and $t_{1''}$, this being the time, whether it be continuous operation of the compressor or the sum of the several cycles of operation, to build up frost on the outdoor coil until a quantity of frost existed to develop the pressure differential $P_B$. At the end of each operation period $t_1$, $t_{1'}$ and $t_{1''}$ (which could be different), a defrost operation takes place. After the termination of the defrost operation, the differential pressure across the coil returns to $P_O$ and another series of operations of the heat pump takes place for the time $t_{1'}$ until the pressure across the coil again built up to $P_B$.

Shown in FIG. 4 is the continuation of the cycles shown in FIG. 3, each having the time period of $t_1$ established by the time necessary to obtain the pressure differential $P_B$. FIG. 4 also shows the updating time control cycle of 90 minutes which would be periodically interposed by the microprocessor time control and control apparatus 32. It is noted that, with this 90 minute cycle, a new differential pressure is established due to different frosting conditions (which may be due to different outdoor temperature and humidity conditions) existing in the 90 minutes of operation. This new pressure differential $P_X$ now is stored in the memory of the microprocessor in place of the previous differential pressure value $P_B$ and the system now reverts to the normal pressure control operation. After the defrost operation, the compressor operation would take place in a different period of $t_2$ which would be required before the frost on the coil resulted in a pressure differential of $P_X$. Subsequent cycles having a pressure controlled operation determined by the new pressure $P_X$ continues until another time controlled 90 minute cycle was interposed to upgrade the stored differential pressure value.

As the microprocessor time control and control apparatus continue to update the stored differential pressure which is required before a defrost operation is initiated, the heat pump control apparatus 32 is continually adjusted to have the longest operating time possible before a defrost operation is brought about for the given outdoor air temperature and humidity conditions. Such a control apparatus minimizes the number of unnecessary defrost operations which occurs in the prior art time control defrost apparatuses. For example, if a strict time control defrost operation were used, a defrost cycle would be started every 90 minutes; however, using the present invention, a defrost operation may not occur for many hours of operation. Assuming that a differential pressure of $P_X$ across the outdoor coil were needed for the initiation of a defrost cycle, and the outdoor temperature were quite high and the outdoor humidity were quite low, it is possible that frost would not form and the compressor would continue under the pressure controlled operation for many hours without the initiation of a defrost cycle.

In addition to the storing of the differential pressure in the memory of the microprocessor, the 90 minute time cycle would be stored, and if any particular pressure controlled operation cycle were less than 90 minutes, such as shown in FIG. 5 as $t_d$, the microprocessor would know that a new value of the differential pressure should be used to replace the previous differential pressure of $P_X$ which was reached in less than 90 minutes. Thus a pressure controlled run would be transposed into a time controlled run as the microprocessor would then continue the operation of the compressor for a 90 minute period to establish a new differential pressure of $P_Y$.

Each time a defrost operation takes place, the pressure differential across the coil should return to the normal pressure of $P_O$ as shown in the previous FIGS. 2–6. Let us assume that a pressure controlled run $t_3$ was accomplished and a $P_Y$ differential pressure which previously was established was reached in the total time of operation of $t_3$. After the defrost operation took place and the coil was cleared of frost, if the pressure upon the initiation of a new operation of the compressor did not return to $P_O$ but to $P_S$, control apparatus 32 knows that a fault condition occurred. This possibly could take place if leaves blew into coil 14 or paper or snow would cover the coil to restrict the air flow through the coil. In any event, with an unrestricted coil, the pressure should be $P_O$ and not being $P_O$ but $P_S$, control apparatus 32 brings about an alarm at 40.

The representative curve of FIG. 7 is made up by the different sampling points for a predetermined number of previous time controlled operations and each subsequent operation of the heat pump is averaged with the previous group of operations. Should the pressure fall outside of the given characteristic, such pressure signal is rejected as not being consistent with the average. For example, if a pressure signal were taken just as a gust of wind hit coil 14, it is possible for a pressure signal to be completely away from the norm and should not be used as a control pressure signal.

FIG. 8 shows the cumulative time operation of the compressor for a pressure controlled operation as frost builds up on the coil until a differential pressure across the coil reaches a value of $P_Y$. This type of operation takes place during any of the previously mentioned operations. In FIG. 8 a specific jump at 50 in the last "on" operation is shown. The microprocessor could sense this continuous sudden change and provide an alarm or indication that a possible fault occurred, such as paper blowing on the coil, or something to indicate a higher differential pressure rather than frost.

The embodiments of the invention in which an exclusive property or right is claimed are defined as follows:

1. In a control system for refrigeration heat pump having an outdoor coil through which air is blown by a fan extracting heat from outdoor air and defrost means to periodically heat the outdoor coil to remove the frost comprising, differential pressure responsive means adapted to respond to the differential air pressure across the outdoor coil, time controlled means adapted for periodically operating the heat pump for a predetermined total time controlled operation sufficient to bring about the frosting of the outdoor coil under predetermined outdoor ambient conditions and thereafter operating said defrost means, whereby a value of differential pressure is measured at the end of said time total period, memory means for maintaining said value of differential air pressure across the coil at the end of said predetermined total time period, control means adapted to control the heat pump between said periodic total time controlled operations for normal operations for new time period extending until said pressure responsive means responds to said value of differential air pressure, and connection means connecting said differential pressure responsive means to operate said defrost means when said value of differential air pressure is attained.

2. The invention of claim 1 wherein said time controlled means, said memory means and said control means is a microprocessor.

3. The invention of claim 1 comprising means connected to said time controlled means for performing several of said total time controlled operations of said heat pump, and means for selecting the highest differential pressure of said several operations for storage in said memory.

4. The invention of claim 1 wherein said normal operations of said heat pump comprising a number of individual operations each of which increases the degree of frost build up on the outdoor coil to establish a higher differential pressure at the end of each of said individual operations, and comprising second memory means connected to said control means for storing values of a plurality of differential pressures from earlier operations and as the differential pressures of a present operation deviates from the stored values, a fault is detected.

5. The invention of claim 4 comprising alarm means connected to said control means, said alarm means being responsive to a predetermined deviation in the present values from said stored values to energize said alarm means.

6. The invention of claim 5 wherein said time control means, said control means, said memory, said second memory means is a microprocessor apparatus.

7. In a control system for refrigeration heat pump having an outdoor coil through which air is blown by a fan for extracting heat from outdoor air and defrost means to periodically heat the outdoor coil to remove the frost comprising, condition responsive means adapted to respond to a condition indicative of frost formation on the outdoor coil, space temperature responsive means adapted to control the refrigeration heat pump upon a need for heat in a space, time controlled means adapted for periodically allowing the heat pump to operate upon a call for heat, by said space temperature responsive means, a predetermined total time period sufficient to bring about the frosting of the outdoor coil under predetermined outdoor ambient air conditions and thereafter initiate operation of said defrost means, whereby a value of said condition is measured at the end of said total time period, memory means for maintaining said value of said condition at the end of said predetermined total time period, and control means connected to said space temperature responsive means adapted to control the heat pump between said periodic time controlled operations for operations for a second total time period extending until said condition responsive means responds to said value of said condition and thereafter operate said defrost means to remove the frost from the outdoor coil.

8. The invention of claim 7 wherein said time controlled means, said memory means and said control means is a microprocessor control apparatus.

9. The invention of claim 7 comprising means connected to said time controlled means for performing several of said predetermined total time period operations of said heat pump, and means for selecting the most significant of said conditions of said several operations to be stored in said memory means.

10. In a method of determining the need of defrost of a forced air heat exchanging outdoor coil of a refrigeration heat system having a condition responsive means responsive to a condition indicative of air flow restriction through the outdoor coil due to frost formation thereon and a time control unit comprising the following steps, operating the heat pump for at least one predetermined total time operation before a defrost operation and then sensing the value of a condition of the coil, operating the heat pump for a total time operation until the same value of condition of the coil exists, and starting an outdoor coil defrost cycle by heating the outdoor coil when said same value of condition exists.

11. In a method of sensing the need of defrost of a forced air heat exchanged outdoor coil of a refrigeration heat system having a differential pressure responsive means responsive to the pressure across the outdoor coil and a time control unit comprising the following steps, operating the heat pump for a timed operation before a defrost operation and then measuring the value of differential pressure existing across the outdoor coil, operating the heat pump for successive operations until said measured value of differential pressure exists, and starting an outdoor coil defrost cycle by heating the outdoor coil when said measured value of differential pressure exists.

12. The invention of claim 7 comprising alarm means, further memory means for maintaining various values of pressure at different operations of the heat pump, deviation responsive means responsive to the differences between present operating air pressures and said various values of said memory, and means connecting said alarm means to said deviation means to be responsive to said differences.

13. In a defrost control system for refrigeration apparatus having an heat exchange coil through which air is blown by a fan for extracting heat from air and defrost means to periodically heat the coil to remove the frost comprising, pressure responsive means adapted to respond to an air pressure indicative of a predetermined restriction of air flow through the coil, time controlled operation means adapted for periodically operating the refrigeration apparatus for a predetermined total time period controlled operation sufficient to bring about the frosting of the coil under predetermined ambient conditions and thereafter operating said defrost means, whereby a value of said air pressure indicative of a predetermined restriction of air flow is measured at the end of said time period, memory means for maintaining said value of air pressure at the end of said predetermined total time period, and control means adapted to control the refrigeration apparatus and the defrost means between said periodic total time controlled operations for normal air pressure controlled operations for new time period extending until said air pressure reaches said value before the defrost means is operated to remove the frost from said coil.

14. In a control system for refrigeration heat pump having an outdoor coil through which air is blown by a fan for extracting heat from outdoor air and defrost means to periodically heat the outdoor coil to remove the frost comprising, condition responsive means adapted to respond to a condition indicative of frost formation on the outdoor coil, space temperature responsive means adapted to control the refrigeration heat pump upon a need for heat in a space, time controlled means adapted for periodically allowing the heat pump to operate upon a call for heat by said space temperature responsive means a predetermined total time period sufficient to bring about the frosting of the outdoor coil under predetermined outdoor ambient air conditions, whereby a value of said condition is measured at the end of said total time period, memory means for maintaining said value of said condition at the end of said predetermined total time period, defrost control means for initiating a defrost cycle at the termination of said total time, means for terminating said defrost cycle after a predetermined time of operation, control means connected to said space temperature responsive means adapted to control the heat pump between said periodic time controlled operations for operations for a second total time period extending until said condition responsive means responds to said value of condition before the defrost means is operated to remove the frost from the outdoor coil, and means responsive to said predetermined time of operation whereby if said time is greater than a selected time, said second total time period is reduced.

15. The invention of claim 14 wherein said second total time is reduced by changing said value of said condition to initiate a defrost operation in a time period shorter than said second total time.

* * * * *